US007502044B2

(12) United States Patent
Shintani

(10) Patent No.: US 7,502,044 B2
(45) Date of Patent: Mar. 10, 2009

(54) THERMAL HEAD AND THERMAL PRINTER

(75) Inventor: Shigetaka Shintani, Kirishima (JP)

(73) Assignee: Kyocera Corporation, Kyoto (JP)

( * ) Notice: Subject to any disclaimer, the term of this patent is extended or adjusted under 35 U.S.C. 154(b) by 183 days.

(21) Appl. No.: 11/404,497

(22) Filed: Apr. 14, 2006

(65) Prior Publication Data

US 2006/0268094 A1 Nov. 30, 2006

Related U.S. Application Data

(60) Provisional application No. 60/674,227, filed on Apr. 21, 2005.

(51) Int. Cl.
*B41J 2/335* (2006.01)

(52) U.S. Cl. ..... 347/203

(58) Field of Classification Search ..... 347/203, 347/200

See application file for complete search history.

(56) References Cited

U.S. PATENT DOCUMENTS 6,256,053 B1 * 7/2001 Noshita ..... 347/203

FOREIGN PATENT DOCUMENTS

JP 5-286154 11/1993
JP 2001-38936 7/1999
JP 2000-177158 6/2000
JP 2001-270141 10/2001

OTHER PUBLICATIONS

Materials from the 15th Annual Thermal Printing Conference, 27 pages, Apr. 2004.
Zebra Introduces P330i® Card Printer/Encoder, PR Newswire, May 13, 2005.
English Translation of JP2001-38936, 18 pages.

* cited by examiner

*Primary Examiner*—K. Feggins
(74) *Attorney, Agent, or Firm*—Hogan & Hartson LLP

(57) ABSTRACT

A thermal head includes a substrate, heating resistors aligned on a surface of the substrate, an electrode pattern connected to the heating resistors, a protective film that covers the heating resistors and the electrode pattern, and a conductive film that covers an upper surface of the protective film. The conductive film has an opening at least in an area above the arrangement of the heating resistors, and the surface of the protective film is exposed through the opening. An edge of the conductive film adjacent to the opening is inclined outward so that the area of the opening gradually increases as the distance from the exposed surface of the protective film. The thermal head may be used as a printing device in facsimile machines and video printers.

36 Claims, 11 Drawing Sheets

Fig.8
Fig.8a
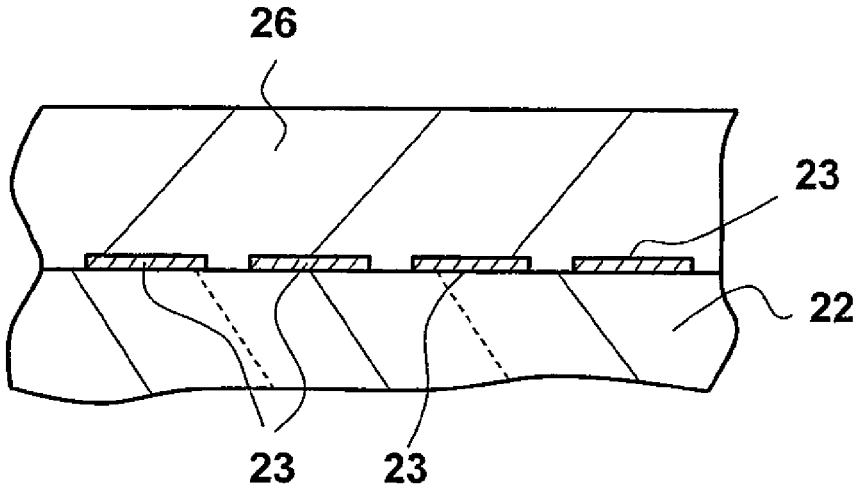
Fig.8b
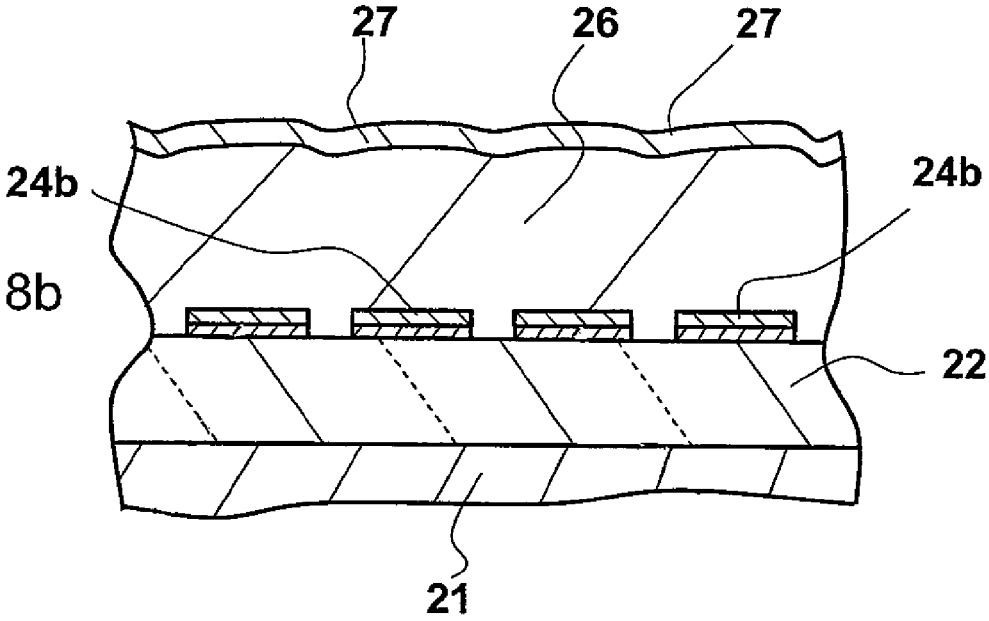

THERMAL HEAD AND THERMAL PRINTER

This application claims priority to U.S. Provisional Application No. 60/674,227, filed Apr. 21, 2005 under 35 USC 119.

BACKGROUND OF THE INVENTION

1. Field of the Invention

The present invention relates to a thermal head that is used as a printing device of a facsimile machine, a video printer or the like and a thermal printer.

2. Description of the Related Art

Conventionally, a thermal head is used as a printing device of a facsimile machine, a video printer or the like.

Such a known conventional thermal head comprises a substrate 101, a plurality of heating resistors 103 and an electrode pattern 104 connected to the heating resistors 103, which are mounted on an upper surface of the substrate 101, and a protective film 106 covering the heating resistors 103 and the electrode pattern 104, as shown in FIG. 11, for example.

A platen roller disposed directly above the heating resistors 103 delivers a recording medium M, such as image receiving paper, onto the heating resistors 103 while pressing the recording medium against the thermal head. At the same time, the heating resistors 103 are selectively made to generate heat by Joule heating based on externally input image data. The recording medium M comes into sliding contact with the surface of the protective film on the heating resistors 103, and the heat generated by the heating resistors 103 is transferred to the recording medium M via the protective film 106, and a printed image is thereby formed on the recording medium M.

The protective film 106 described above is made of a Si—O—N-based inorganic material having a high abrasion resistance and serves to protect the heating resistors 103 and the electrode pattern 104 against wear due to sliding contact with the recording medium M and corrosion due to exposure to moisture or the like in the atmosphere.

In the thermal head described above, if the recording medium M repeatedly comes into sliding contact with the surface of the protective film on the heating resistors, some of the static electricity on the surface of the recording medium M is accumulated on the protective film 106, and discharge occurs between the protective film 106 and the heating resistors 103, causing dielectric breakdown of the protective film 106. Thus, there is a problem that the protective film 106 loses functionality.

In order to solve the problem described above, it has been proposed that a conductive film made of an electrical resistive material of TaSiO is disposed on the protective film 106 (see Japanese Patent Laid-Open No. 2000-177158).

However, the surface of the recording medium M is rougher than the conductive film, and therefore, the frictional resistance between the recording medium M and the conductive film is particularly high in an area directly above the heating resistors and in the vicinity of the area where the pressing force of the platen roller is best transferred. Because of the frictional resistance, there arises a problem that the recording medium M is partially scraped off to produce many paper residues, and the paper residues hinder stable delivery of the recording medium M.

The present invention has been devised to solve the problems described above, and an object of the present invention is to provide a high-performance thermal head that allows a protective film to adequately serve for a long time and a recording medium M to be delivered stably and a thermal printer.

BRIEF SUMMARY OF THE INVENTION

In one typical embodiment of the present invention, a thermal head has a protective film that covers an heating resistor and an electrode pattern, and a conductive film that covers an upper surface of said protective film, wherein said conductive film has an opening at least in an area above the arrangement of the heating resistors, the surface of the protective film is exposed through the opening, and an edge of said conductive film adjacent to said opening is inclined outward in a direction perpendicular to the direction of the arrangement of the heating resistors.

In another embodiment of the present invention, a thermal head has a protective film that covers an heating resistor and an electrode pattern, and a conductive film that covers an upper surface of said protective film, wherein the surface of said protective film is exposed through said conductive film in a region downstream of the heating resistor in a direction of delivery of a recording medium, and the surface of an end portion of said conductive film and the surface of the protective film are connected seamlessly to each other.

In 3rd embodiment of the present invention, a thermal head has a protective film that covers an heating resistor and an electrode pattern, and a conductive film that covers an upper surface of said protective film, wherein the surface of said protective film is exposed through said conductive film in a region downstream of the heating resistor in a direction of delivery of a recording medium, and the thickness of the conductive film extending over the electrode pattern is gradually decrease toward the area above the heating resistors.

BRIEF DESCRIPTION OF THE DRAWINGS

FIG. 8(*a*) is an enlarged cross-sectional view showing the part shown in FIG. 7 taken along the line x-x';

FIG. 8(*b*) is an enlarged cross-sectional view showing the part shown in FIG. 7 taken along the line y-y';

DETAILED DESCRIPTION OF THE INVENTION

In the following, the present invention will be described in detail with reference to the accompanying drawings.

Embodiment 1

Figure 1:
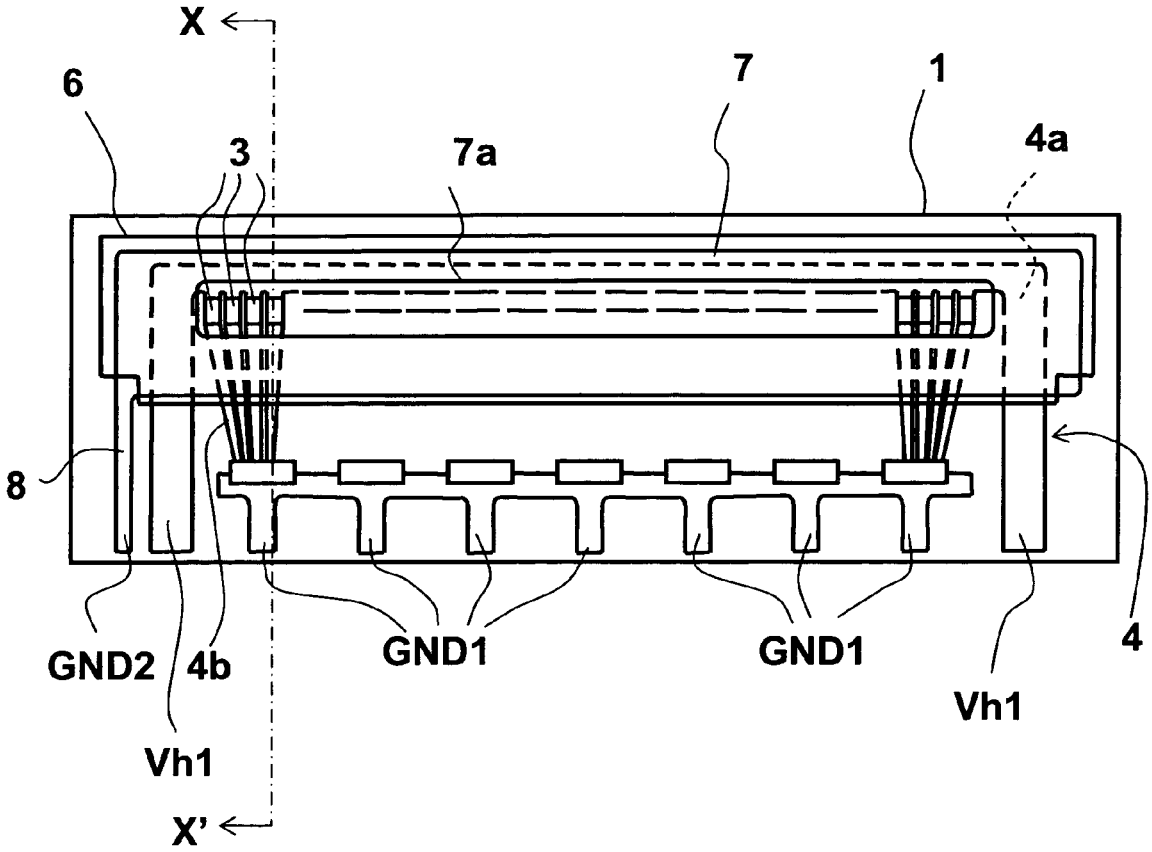
FIG. 1 is a plan view of a thermal head according to an embodiment 1 of the present invention.
Figure 2:
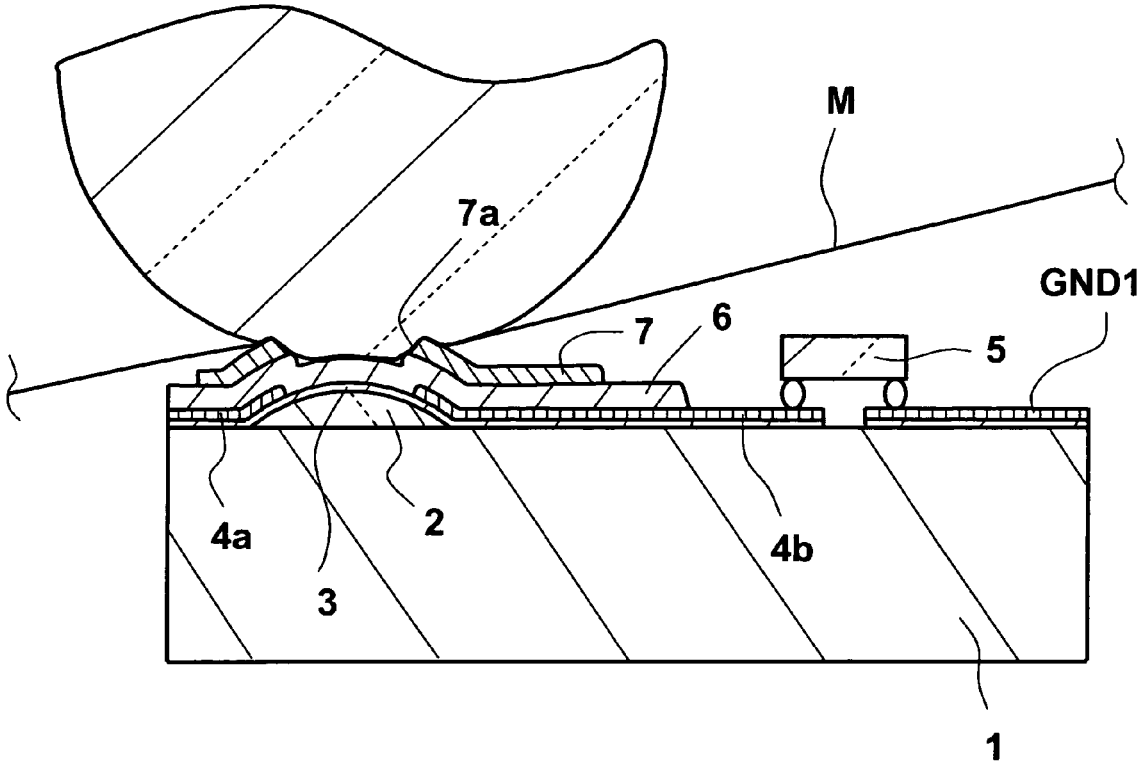
FIG. 2 is a cross-sectional view of the thermal head shown in FIG. 1 taken along the line X-X'.
Figure 3:
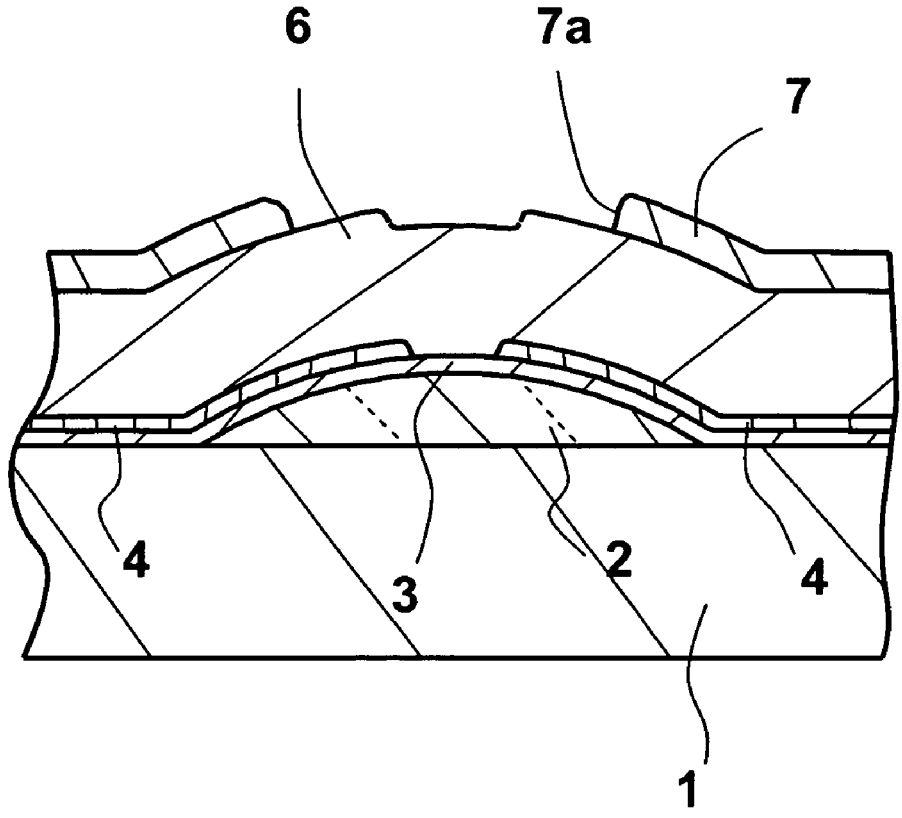
FIG. 3 is an enlarged cross-sectional view of a part of the thermal head shown in FIG. 2.

FIG. 1 is a plan view of a thermal head according to an embodiment 1 of the present invention, FIG. 2 is a cross-sectional view of the thermal head shown in FIG. 1 taken along the line X-X', and FIG. 3 is a cross-sectional view of essential parts of the thermal head shown in FIG. 2. Generally, the thermal head shown in these drawings comprises a substrate 1, and a heating resistor 3, an electrode pattern 4, a protective film 6, a conductive film 7 and an electrode wiring 8 mounted on an upper surface of the substrate 1.

The substrate 1 has a rectangular shape and is made of an insulating material, such as alumina ceramic, or a semiconductor material, such as single-crystal silicon with a silicon oxide film or silicon nitride film formed on the surface thereof. On the upper surface of the substrate 1, a plurality of heating resistors 3, the electrode pattern 4, the protective film 6, the conductive film 7, the electrode wiring 8 and the like are mounted, and the substrate 1 serves as a supporting base plate therefor.

In the case where the substrate 1 is made of alumina ceramic, for example, the substrate 1 is fabricated by adding a suitable organic solvent to or mixing the same with a ceramic material powder, such as alumina, silica and magnesia, forming the resulting mixture into a ceramic green sheet by a conventionally known doctor blade method, calendar roll method or the like, die-cutting the ceramic green sheet into a rectangular shape, and then baking the die-cut rectangular ceramic green sheet at a high temperature (about 1600 degrees Celsius)

A partial glaze layer 2 made of glass in the form of a strip extending in the longitudinal direction of the substrate 1 is mounted on the upper surface of the substrate 1. A plurality of heating resistors 3 are provided in the vicinity of the top of the partial glaze layer 2.

The partial glaze layer 2 has an arc shape having a radius of curvature of 1 mm to 4 mm in cross section, for example, and has a thickness of 20 μm to 160 μm at the thickest part thereof.

The partial glaze layer 2 is made of glass of a low thermal conductivity (of 0.7 W/m·K to 1.0 W/m·K). Therefore, the partial glaze layer 2 can accumulate some of the heat generated therein by the heating resistors 3 to maintain a high thermal response of the thermal head. More specifically, the partial glaze layer 2 serves as a heat accumulating layer that raises the temperature of the heating resistors 3 in a short time to a predetermined temperature required for printing.

The heating resistors 3 are aligned in a line in a main scanning direction with a density of 600 dpi (dot per inch), for example. Each of the heating resistors 3 is made of an electrically resistive material, such as a TaSiO-based material, a TiSiO-based material and a TiCSiO-based material, and has a length of 35 μm in the main scanning direction and a length of 70 μm in a sub-scanning direction.

When an electrical power is externally supplied to the plural heating resistors 3 via the electrode pattern 4 connected to the opposite ends thereof, Joule heating occurs in the heating resistors 3, and the temperature of the heating resistors 3 is raised to a temperature required to form a printed image on a sheet of image receiving paper, for example, a temperature from 150 degrees Celsius to 400 degrees Celsius.

The electrode pattern 4 connected to the opposite ends of each heating resistor 3 is made of a metal material, such as aluminum (Al) and copper (Cu), and is composed of a common electrode pattern 4*a* connected in common to one ends of the heating resistors 3 and separate electrode patterns 4*b* individually connected to the other ends of the heating resistors 3. The common electrode pattern 4*a* is connected to a power supply terminal (Vh1) maintained at a predetermined potential (24 V, for example), and the separate electrode patterns 4*b* are each connected to a first grounding terminal (GND1) maintained at a ground potential (0 V, for example) via a switching element of a driver IC 5. Energization of the heat resistors 3 is controlled by turning on and off the switching elements of the driver ICs 5.

Each driver IC 5 has, on a circuit forming surface (lower surface) thereof, an electronic circuit having a shift resistor, a latch circuit, a switching element, a terminal and the like integrated thereon. The plurality of heating resistors 3 can be selectively made to generate heat by selectively turning on and off the switching elements of the driver ICs 5.

Such a driver IC 5 may be a flip-chip IC having an electronic circuit and a terminal mounted on the lower surface thereof, for example. The driver IC 5 is electrically connected to the electrode pattern 4 by conventionally known face down bonding, that is, by soldering a terminal of the driver IC 5 to a corresponding terminal on the electrode pattern 4.

The plurality of heating resistors 3 and the paired electrode pattern 4 are mounted or formed on the upper surface of the substrate 1 in predetermined patterns by a conventionally known thin-film forming technique, such as sputtering, photolithography and etching.

The driver IC 5 is fabricated by forming an ingot of single-crystal silicon by a conventionally known Czochralski method (a pulling method), slicing the ingot to form a plate using a diamond cutter or the like, and then forming a highly integrated electronic circuit including a shift resistor, a latch circuit and the like on one principal plane of the plate by a conventionally known semiconductor manufacturing technique.

The protective film 6 is mounted on the heating resistors 3 and the electrode pattern 4, and the heating resistors 3 and the paired electrode pattern 4 are covered in common with the protective film 6.

The protective film 6 is made of an inorganic material having a high abrasion resistance, such as silicon nitride ($Si_3N_4$), silicon oxide ($SiO_2$) and SIALON (Si—Al—O—N) and serves to protect the heating resistors 3, the electrode pattern 4, the electrode wiring 8 described later and the like against wear due to sliding contact with the recording medium M and corrosion due to exposure to moisture or the like in the atmosphere.

The protective film 6 is formed by depositing an inorganic material, such as silicon nitride ($Si_3N_4$), silicon oxide ($SiO_2$) and SIALON (Si—Al—O—N), on the upper surface of the heating resistors 3, the electrode pattern 4, the electrode wiring 8 described later and the like to a thickness of 5 μm to 10 μm by a conventionally known thin-film forming technique, such as chemical vapor deposition (CVD) and sputtering. More specifically, in the case where the protective film 6 of silicon nitride ($Si_3N_4$) is formed by sputtering, a target made of a sintered body of silicon nitride ($Si_3N_4$) and the substrate 1 having the heating resistors 3, the electrode pattern 4 and the like mounted thereon are placed in a chamber of a sputtering apparatus, and a predetermined voltage is applied between the target and the substrate 1 while introducing argon gas into the chamber to sputter the target material onto a predetermined area of the substrate 1, thereby forming the protective film 6. In this process, the pressure in the chamber is set at 0.4 Pa to 0.6 Pa, and the substrate temperature is set at 150 degrees Celsius to 200 degrees Celsius, and thus, the arithmetic-average surface roughness Ra of the protective film 6 is set at 0.06 μm or less (measured in conformity to recommended values defined in JIS B0601-1994 and JIS B0633-2001, the same holds true for the following description of the present invention).

On the protective film 6, the conductive film 7 is disposed over the area of the heating resistors 3.

The conductive film 7 is made of an electrically resistive material or the like containing Si, C, Ta or the like, such as TaSiO and TaSiNO, (whose specific resistance is $5\times10^{-4}$ Ω.cm to $2\times10^{-4}$ Ω.cm) and has the shape of a strip extending in the main scanning direction. The conductive film 7 has a groove 7*a* directly above the heating resistors 3, and the surface of the protective film 6 is exposed at the groove 7*a*.

The conductive film 7 is connected to a second grounding terminal (GND2) maintained at a ground potential (0 V, for example) via the electrode wiring 8 at one end thereof and, therefore, is always maintained at the ground potential.

Thus, during the recording operation, even if much static electricity is accumulated in the recording medium M delivered onto the heating resistors 3 by a platen roller, the static electricity on the surface of the recording medium M is dissipated to the ground via the conductive film 7 when a part of the recording medium M comes into contact with the conductive film 7. Therefore, the protective film 6 is highly prevented from accumulating much static electricity, so that dielectric breakdown of the protective film 6 can be effectively prevented and the protective film 6 can serve adequately for a long time.

In addition, as described above, the conductive film 7 has an opening (the groove 7*a*, for example) directly above the heating resistors 3, and the surface of the protective film 6 is exposed at the opening. Therefore, at the top of the heating resistors 3 where the pressing force of the platen roller applied to the thermal head tends to be highest, the recording medium M is direct sliding contact with the surface of the protective film 6 which has a relatively low surface roughness (0.06 μm or less in terms of arithmetic average roughness Ra, for example), so that the friction between the recording medium M and the thermal head can be effectively reduced. Thus, a paper residue can be effectively prevented from being produced due to sliding contact between the recording medium M and the thermal head, and the recording medium can be delivered stably.

The protective film 6 described above has a step part corresponding to the heating resistors 3. This step part reflects the height difference at the edge of the electrode pattern 4 that is formed by removing a part corresponding to the heating resistors 3 from a thin film made of a metal or the like. The conductive film 7 is formed on such a protective film 6. According to the present invention, the edge of the opening in the conductive film 7 is located outward from the step part. That is, along the direction of delivery of the recording medium, the upstream-side edge of the opening in the conductive film 7 is located upstream of the upstream-side edge of the step part of the protective film 6, and the downstream-side edge of the opening in the conductive film 7 is located downstream of the edge of the downstream-side edge of the step part of the protective film 6.

In addition, a plurality of openings corresponding to the heating resistors may be provided, or one opening in the form of the groove 7*a* extending along the heating resistors may be provided.

If the arithmetic-average surface roughness Ra of the protective film exposed at the groove 7*a* is greater than 0.06 μm, sticking can occur on the recording medium M when the pressing force of the platen roller on the thermal head is particularly high.

The length of the groove 7*a* in the sub-scanning direction is preferably three to six times greater than the length of the heating resistors 3 in the sub-scanning direction. If the length of the groove 7*a* in the sub-scanning direction is less than three times the length of the heating resistors 3 in the sub-scanning direction, the exposed area of the protective film 6 is small, so that the effect of reducing the frictional force between the recording medium M and the thermal head tends to decrease when the pressing force of the platen roller on the thermal head is particularly high. On the other hand, if the length of the groove 7*a* in the sub-scanning direction is more than six times the length of the heating resistors 3 in the sub-scanning direction, it is difficult to make the recording medium and the conductive film 7 come into contact with each other during the recording operation, and thus, the static electricity on the recording medium is hard to dissipate via the conductive film. Therefore, it is preferred that the length of the groove 7*a* in the sub-scanning direction is three to six times greater than the length of the heating resistors 3 in the sub-scanning direction.

Figure 4:
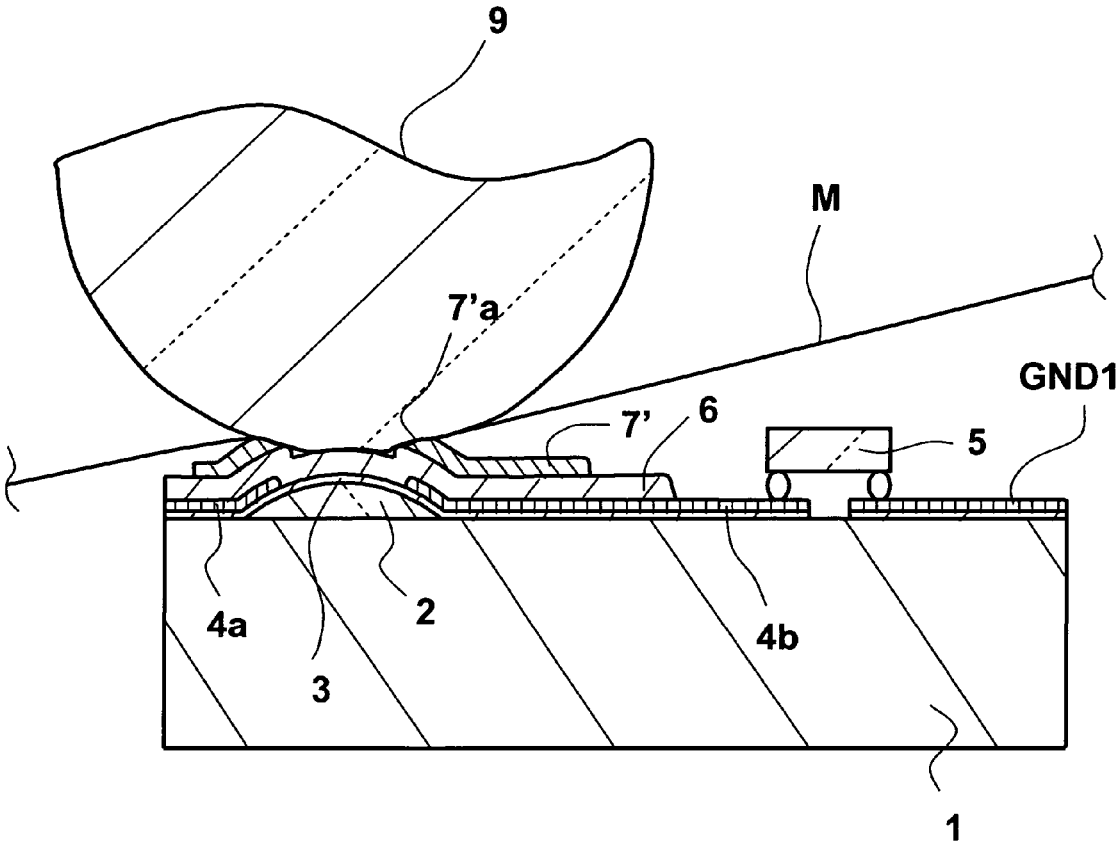
FIG. 4 is a cross-sectional view of a thermal head of an alternative configuration according to the present invention.
Figure 5:
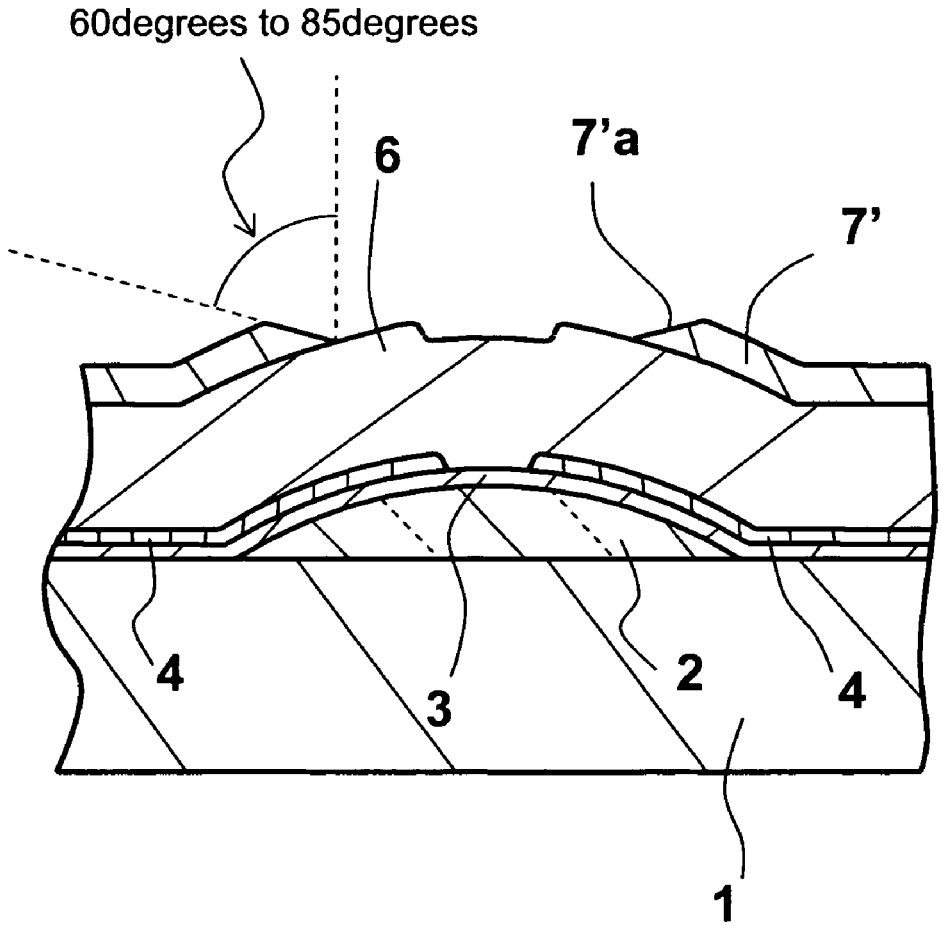
FIG. 5 is an enlarged cross-sectional view of a part of the thermal head shown in FIG. 4.

Furthermore, in this embodiment, if the inner surface of a groove 7'*a* is inclined outward so that the opening area of the groove 7'*a* gradually increases as the distance from the recording medium M decreases as shown in FIGS. 4 and 5, the recording medium M more easily comes into contact with the surface of the protective film. Thus, there are advantages that the effect of reducing the frictional force between the recording medium M and the thermal head is further enhanced, and that the recording medium M is effectively prevented from being damaged by the corner defined by the groove 7'*a* and the surface of a conductive film 7'.

Furthermore, in this case, since the inner surface of the groove 7'*a* and the surface of the protective film are connected to each other almost seamlessly, the stress caused by the friction with the recording medium is effectively prevented from being concentrated at the boundary between the inner surface of the groove 7'*a* and the surface of the protective film, and peeling of the conductive film 7' starting at the groove 7'*a* can be substantially prevented.

The inner surface of the groove 7'*a* is preferably inclined 60 degrees to 85 degrees from the vertical direction (the direction perpendicular to the upper surface of the substrate 1). If the inclination angle of the inner surface of the groove 7'*a* is below the angle range described above, the corner defined by the surface of the groove 7'*a* and the surface of the conductive film 7' may damage the recording medium M when the pressing force of the platen roller on the thermal head is particularly high. On the other hand, if the inclination angle of the inner surface of the groove 7'*a* is beyond the angle range described above, working of the groove 7'*a* is difficult.

The conductive film 7 described above is formed by depositing an electrically resistive material, TaSiO and TaSiNO, on a predetermined area of the protective film 6 to, a thickness of 0.02 μm to 0.2 μm by a conventionally known thin-film forming technique, such as CVD and sputtering, as with the protective film 6 described above. Then, the groove 7*a* is formed at a predetermined area in the conductive film 7 by conventionally known photolithography and etching. The conductive film 7 has a surface roughness of 0.06 μm to 0.08 μm in terms of arithmetic average roughness Ra. The groove 7*a* may be formed by polishing the area of the surface of the conductive film directly above the heating resistors using a lapping film, rather than by etching.

At one end of the conductive film 7, the electrode wiring 8 made of a metal material, such as aluminum (Al) and copper (Cu), is formed in a predetermined pattern and serves to connect the conductive film 7 to the second grounding terminal (GND2) to maintain the conductive film 7 at the ground potential. The electrode wiring 8 is formed simultaneously with the electrode pattern 4 by the same method as the electrode pattern 4.

The present invention is not limited to the particular embodiment described above, and various modification and improvements can be made without departing from the spirit of the present invention.

For example, in the embodiment described above, the conductive film 7 is always maintained at the ground potential. Instead, however, the conductive film 7 may be maintained at the ground potential only for a certain period of time.

Furthermore, in the embodiment described above, the conductive film 7 maybe made of the same material as the heating resistors 3 and may have a multi layered structure. In the latter case, if the specific resistance of the lowermost layer is equal to or more than $1\times10^7$ Ω.cm, electrical short circuit between the conductive film and the electrode can be extremely highly prevented even if many pinholes or the like are formed in the protective film, which is a base material for the conductive film.

Furthermore, in the embodiment described above, of course, the protective film 6 may have a multilayered structure including two or more layers.

Embodiment 2

Now, an embodiment 2 of the present invention will be described.

Figure 6:
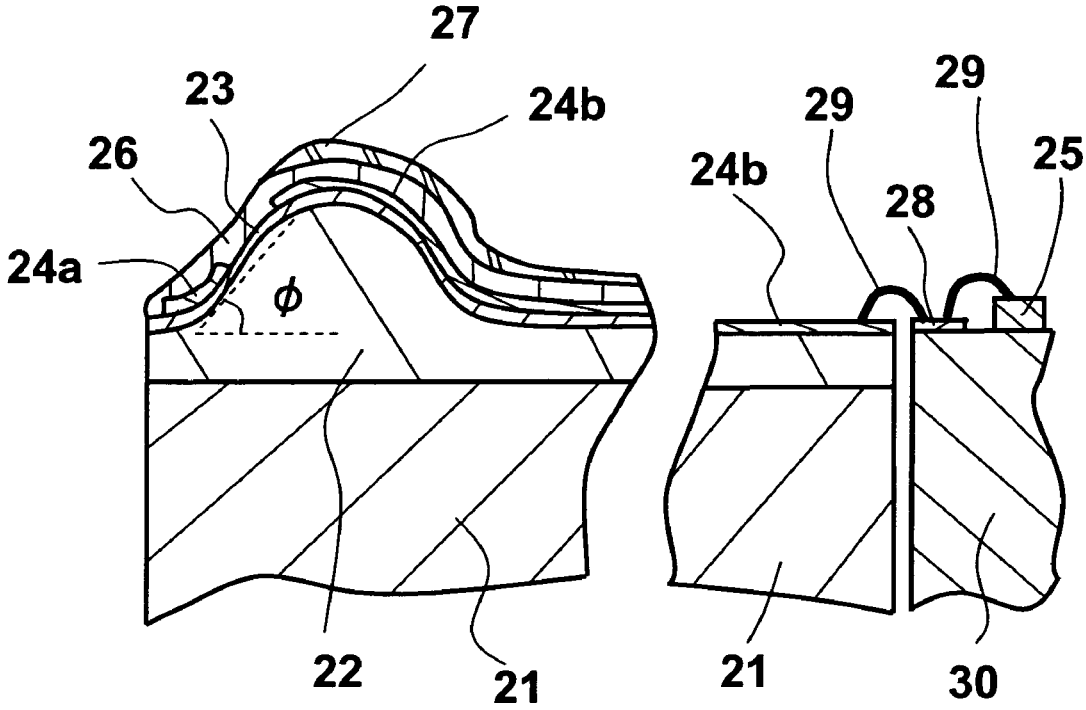
FIG. 6 is a cross-sectional view of a thermal head according to an embodiment 2 of the present invention.
Figure 7:
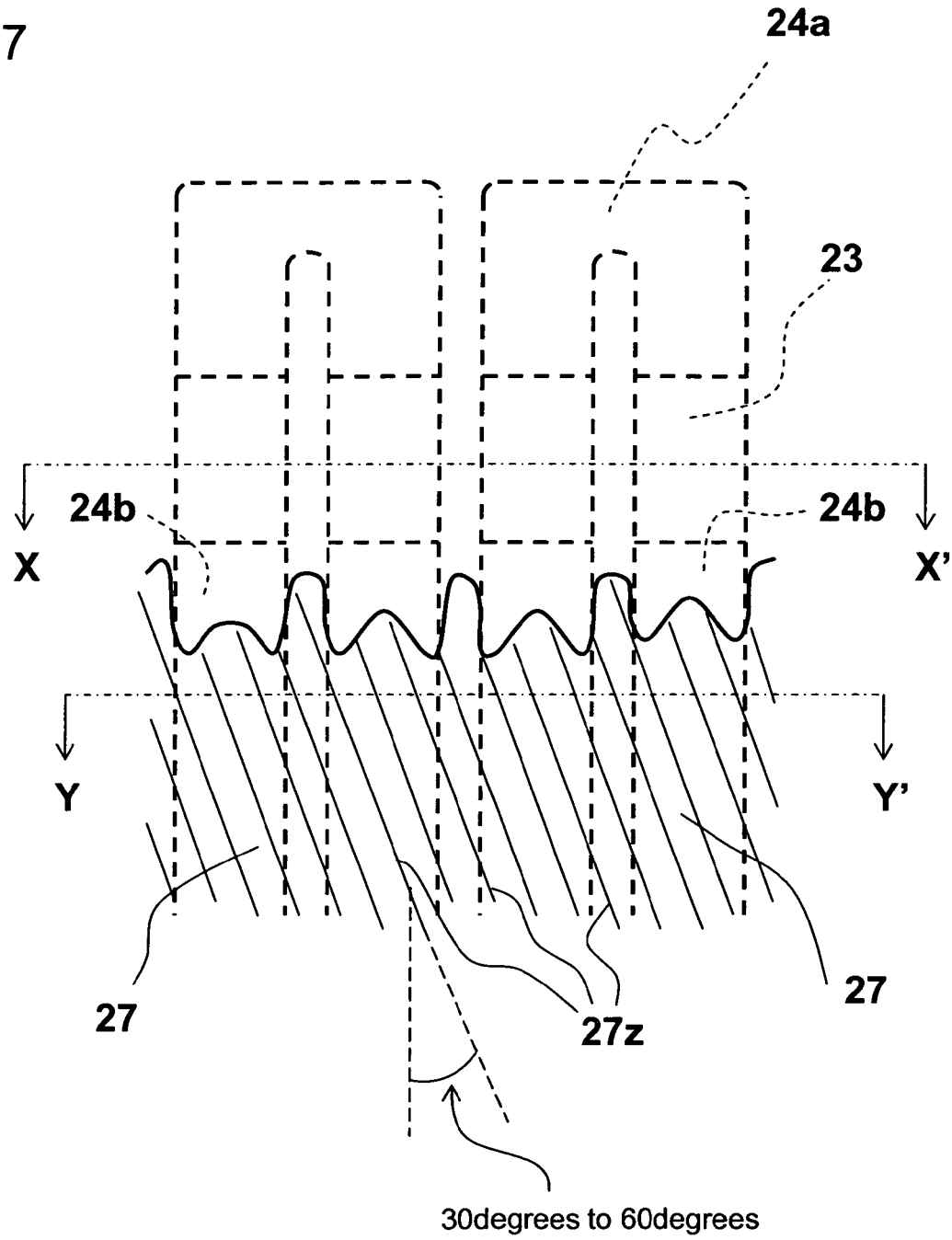
FIG. 7 is an enlarged plan view of a part of the thermal head shown in FIG. 6.

FIG. 6 is a cross-sectional view of a thermal head according to an embodiment 2 of the present invention, FIG. 7 is an enlarged plan view of essential parts of the thermal head shown in FIG. 6, and FIG. 8 includes cross-sectional views of the thermal head shown in FIG. 7 taken along the lines x-x' and y-y', respectively.

A substrate 21 has a rectangular shape and is made of alumina ceramic. On the upper surface of the substrate 21, a plurality of heating resistors 23, an electrode pattern 24, a protective film 26, a conductive film 27 and the like are mounted, and the substrate 21 serves as a supporting base plate therefor.

A partial glaze layer 22 made of glass in the form of a strip extending in the longitudinal direction of the substrate 21 is mounted on the upper surface of the substrate 21. A plurality of heating resistors 23 are provided on the partial glaze layer 22. The partial glaze layer 22 has a convex shape and is formed on a glaze base layer covering the whole of the upper surface of the ceramic substrate 11. The plurality of heating resistors 23 and the electrode pattern 24 are both formed on the glaze base layer or partial glaze layer, and therefore, the electrode pattern can be readily formed with high precision compared with the case where the heating resistors 23 and the electrode pattern 24 are formed directly on the upper surface of the substrate 21 whose surface is rough.

The partial glaze layer 22 is located in the vicinity of and end of the substrate 21, has an arc shape having a radius of curvature of 1 mm to 2 mm in cross section and has a thickness of 75 μm to 95 μm at the thickest part thereof. The radius of curvature and the thickness of the thickest part are determined to achieve optimum conditions in terms of the frictional force between the recording medium and the thermal head, the continuity of delivery of the recording medium, the mechanical impact on the protective film and the efficiency of heat transfer from the heating resistors in the case where a recording medium having a high rigidity, such as a plastic card, is delivered while being in intimate contact with the thermal head by the action of a platen roller. If the radius of curvature is less than 1 mm, the pressing force applied to a unit area of the recording medium is too high, so that the mechanical impact on the thermal head is also too high. On the other hand, if the radius of curvature is more than 2 mm, the efficiency of heat transfer from the heating resistors is too low, although the mechanical impact is low.

The heating resistors 23 are aligned in a line in a main scanning direction with a density of 600 dpi (dot per inch), for example. Each of the heating resistors 23 is made of an electrically resistive material, such as a TaSiO-based material, a TaCSiO-based material, a TiSiO-based material and a TiCSiO-based material, and has a length of 35 μm in the main scanning direction and a length of 70 μm in a direction of delivery of the recording medium.

The area in which the plurality of heating resistors 23 are formed is shifted from the top of the partial glaze layer 22 downstream in the direction of delivery of the recording medium by 250 μm to 300 μm. As a result, the tangent to the partial glaze layer 22 at the area of the heating resistors 23 and the upper surface of the substrate 21 form an angle Φ of 3 degrees to 15 degrees. Thus, the thermal head can be placed in a substantially inclined position with respect to the recording medium having a high rigidity, such as a plastic card, so that the recording medium can be delivered and a printed image can be formed on the recording medium substantially without bending the recording medium.

Each heating resistor 23 is connected to the electrode pattern 24 at both the ends. When an electrical power is externally supplied to the heating resistors 23, Joule heating occurs in the heating resistors 23, and the temperature of the heating resistors 23 is raised to a temperature required to form a printed image on a sheet of image receiving paper, for example, a temperature from 150 degrees Celsius to 400 degrees Celsius.

The electrode pattern 24 connected to the heating resistors 23 is composed of an electrode pattern 24*a* having a folded shape or more specifically a U-shape that is connected to one ends of two heating resistors 23 to couple the heating resistors 23, and separate electrode patterns 24*b* individually connected to the other ends of the heating resistors 23. As for two heating resistors 23 coupled by each electrode pattern 24*a*, the separate electrode pattern 24*b* connected to one of the heating resistors 23 is connected to a power supply terminal (Vh1) maintained at a predetermined potential (24 V, for example), and the separate electrode pattern 24*b* connected to the other heating resistor 23 is connected to a first grounding terminal (GND1) maintained at a ground potential (0 V, for example) via a switching element of a driver IC 25. Energization of the pair of heat resistors 23 is controlled by turning on and off the switching element of the driver IC 25.

The driver IC 25 is mounted on a wiring substrate 30 disposed adjacent to the substrate 21 to supply electric power to the heating resistors 23. Since the driver IC 25 is mounted on the wiring substrate 30, the IC mounting area on the substrate 21 can be omitted, so that the substrate 21 can be reduced in size. The driver IC 25 is electrically connected to the electrode pattern 24*b* by a terminal of the driver IC 25 being bonded to a terminal on a corresponding signal electrode 28 via a gold wire 29.

The protective film 26 is mounted on the heating resistors 23 and the electrode pattern 24, and the heating resistors 23 and the electrode patterns 24*a* and 24*b* are covered in common with the protective film 26.

According to the present invention, the protective film 26 is made of an inorganic material having a high abrasion resistance, such as silicon nitride ($Si_3N_4$), silicon oxide ($SiO_2$) SIALON (Si—Al—O—N) and a Si—O—N-based material containing carbon (C).

In this embodiment 2, the protective film 26 is formed by depositing a C—Si—O—N-based inorganic material on the upper surface of the heating resistors 23, the electrode pattern 24 and the like to a thickness of 6 μm to 10 μm by a conventionally known sputtering method.

The thickness of the protective film 26 on the heating resistors 23 (the thickness in the direction perpendicular to the tangent plane to the part of the protective film directly above the heating resistors 23 each extending in the delivery direction) is 90% to 100% of the thickness of the remaining part of the protective film 26. This is because, when the part of the conductive film 27 described later directly above the heating resistors 23 is polished and removed, the surface of the underlying protective film 26 can be slightly scraped off. If the protective film 26 is polished in this way, the surface-roughness of the protective film 26 can be reduced, and the thermal response thereof can be improved, as described above.

Here, the thickness of 100% means a case where the protective film 26 is not polished, and only the conductive film 27 is removed. Even in this case, it is assured that the surface of the protective film 26 has a sufficient smoothness, so that the thermal head can serve without any problem.

Since the surface of the protective film 26 is exposed where the conductive film 27 is removed directly above the heating resistors 23, the recording medium M comes into direct sliding contact with the surface of the protective film having a relatively low surface roughness (0.06 μm or less, or more preferably, 0.03 μm or less in terms of arithmetic average roughness Ra) directly above the heating resistors 23 where the pressing force of the platen roller on the thermal head is highest, so that the frictional resistance between the recording medium M and the thermal head can be effectively reduced. Thus, a paper residue can be effectively prevented from being produced due to sliding contact between the recording medium M and the thermal head, and the recording medium M can be delivered stably.

If the arithmetic-average surface roughness Ra of the exposed part of the protective film 26 is greater than 0.06 μm, sticking can occur on the recording medium M when the pressing force of the platen roller on the thermal head is particularly high. Thus, the surface roughness of the protective film 26 is preferably set at 0.06 μm or less in terms of arithmetic average roughness Ra.

On the protective film 26, the conductive film 27 is disposed.

As with the protective film 26, the conductive film 27 is formed by depositing an electrically resistive material, such as TaSiO and TaSiNO, on the upper surface of the protective film 26 to a thickness of 0.02 μm to 1.0 μm by a conventionally known thin-film forming technique, such as CVD and sputtering, and has the shape of a strip extending in the main scanning direction.

In addition, if the conductive film 27 has a Vickers hardness lower than that of the protective film 26 (or lower than that of the uppermost layer of the protective film 26 in the case where the protective film 26 has a multilayered structure), the conductive film 27 can be easily removed by in the etching or polishing step. In the embodiment 2, the protective film made of a C—Si—O—N-based material has a Vickers hardness of about 1900, and the conductive film made of a Ta—Si—O-based material has a Vickers hardness of about 900.

In this regard, to determine the Vickers hardness Hv, a diamond pyramid indenter having an apex angle of 136 degrees is statically pressed against the surface to be measured. The Vickers hardness Hv is determined as the load necessary to form a recess in the surface divided by the surface area of the recess as described below.

Vickers hardness $Hv=1.854\ P/d^2\ (kg/mm^2) \leqq 18.1692\ P/d^2$ (MPa)

Furthermore, the distance between the central point of each heating resistor 23 along the recording medium delivery direction and the end of the substrate downstream in the recording medium delivery direction is reduced, specifically about 0.2 mm to 0.4 mm. And, the conductive film 27 mainly extends over the area upstream of the heating resistors in the recording medium delivery direction, excluding the area directly above the heating resistors. In the part directly above the heating resistors 23 and the part downstream of the heating resistors 23 in the recording medium delivery direction, an area of conductive film 27 that is expected to come into sliding contact with the recording medium is adequately removed along the recording medium delivery direction.

Alternatively, as shown in FIGS. 6 to 9, the thickness of the conductive film 27 extending over the separate electrode patterns 24*b* may gradually decrease toward the area directly above the heating resistors 23. In the area directly above the heating resistors 23, there is no conductive film 27. The end portion of the conductive film 27 close to the area directly above the heating resistors 23 may has a tapered shape so that the width decreases in the downstream direction of the recording medium delivery.

Furthermore, the level of the part of the conductive film 27 directly above the gap between two adjacent separate electrode patterns 24*b* may be lower than that of the parts of the conductive film 27 directly above the separate electrode patterns 24*b*, so that the conductive film 27 remains without being polished.

As described above, in the thermal head according to the present invention, the parts of the conductive film 27 directly above the gaps between the adjacent twos of the separate electrode patterns 24*b* extend longer in the downstream direction of the recording medium delivery than the parts of the conductive film 27 directly above the separate electrode patterns 24*b*. Thus, the conductive film 27 is partially in contact with the recording medium M for a longer time, so that the static electricity generated between the recording medium M and the protective film 26 on the surface of the head can be more readily dissipated to the conductive film 27.

In addition, since the conductive film 27 and the protective film 26 directly above the separate electrode patterns 24*b* are connected to each other almost or completely seamlessly, the recording medium M can be delivered smoothly. In this embodiment, such structure is also called seamless.

Figure 9:
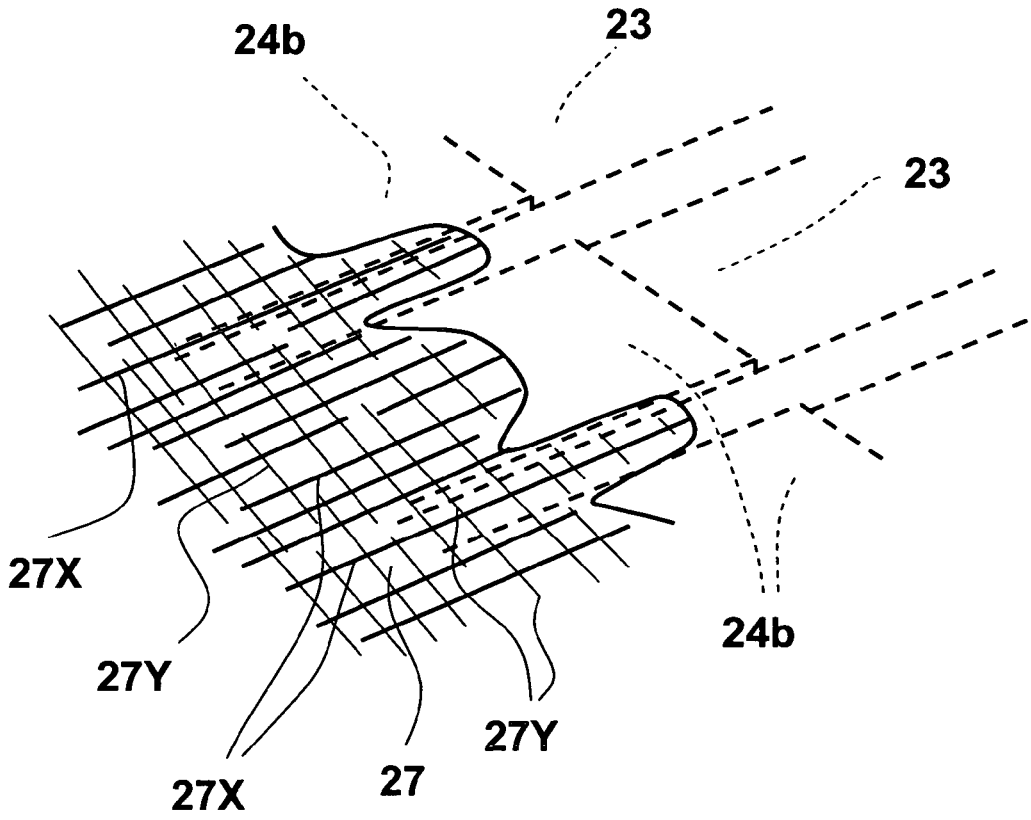
FIG. 9 is an enlarged cross-sectional view of a part of an electrode pattern 24*b;*

Furthermore, as shown in FIG. 9, the conductive film 27 directly above the heating resistors 23 has a plurality of fine recesses 27*x* extending in the recording medium delivery direction. In addition, the conductive film 27 has a fine recess 27*y* extending in the direction perpendicular to the direction of the fine recesses 27*x*. The fine recesses 27*x* are deeper and wider than the fine recess 27*y*. The fine recesses 27*x* and 27*y* can be formed simultaneously by a technique called lapping during removal of the conductive film 27.

If the deeper and wider fine recesses 27*x* extend in the recording medium delivery direction, the increase of the frictional resistance can be suppressed compared with the case where the fine recesses 27*x* extends in the direction perpendicular to the recording medium delivery direction.

Furthermore, as shown in FIG. 7, the conductive film has a fine recesses 27*z*. A direction of the fine recesses 27*z* may be inclined from the delivery direction of the recording medium by a predetermined angle in a plane view, for example, 30 degrees to 60 degrees. In this case, paper residues sticking to the recording medium can be introduced into grooves between heating resistors, and thus, paper residues remaining between the recording medium and the heating resistors can be reduced, and degradation of the quality of the printed image can be prevented.

With such a configuration, directly above the heating resistors 23 where the pressing force of the platen roller on the thermal head tends to be highest, the recording medium M is direct sliding contact with the surface of the protective film 26 having a relatively low surface roughness, so that the frictional resistance between the recording medium M and the thermal head can be effectively reduced. Thus, a paper residue can be effectively prevented from being produced due to sliding contact between the recording medium M and the thermal head, and the recording medium can be delivered stably.

Furthermore, while one end of the conductive film 7 is connected to the second grounding terminal (GND2) maintained at the ground potential (0 V, for example) via the electrode wiring in the embodiment 1, in the embodiment 2, a part of the electrode pattern is not covered with the protective film 26, and the conductive film 27 is in direct contact with the electrode pattern maintained at the ground potential. Thus, the potential of the conductive film 27 is always maintained at the ground potential.

Thus, during the recording operation, even if much static electricity is accumulated in the recording medium M delivered onto the heating resistors 23 by a platen roller, the static electricity on the surface of the recording medium M can be dissipated to the ground via the conductive film 27 when a part of the recording medium M comes into contact with the conductive film 27. Therefore, the protective film 26 is highly prevented from accumulating much static electricity, so that dielectric breakdown of the protective film 26 can be effectively prevented and the protective film 26 can serve adequately for a long time.

Even if the conductive film is not connected to any electrode, the static electricity can be removed using an antistatic roller or brush, a guide roller for the recording medium M, a conductive platen roller or the like provided on the printer rather than on the thermal head.

Now, a method of removing the conductive film 27 in the embodiment 2 will be described. In the embodiment 2, the conductive film 27 can be removed by polishing referred to as lapping.

First, a first polishing is performed along the delivery direction of the recording medium. Then, a second polishing is performed in the direction perpendicular to the delivery direction using a finer abrasive material (lapping film) than in the first polishing.

In the polishing process, the step between the surface of the conductive film 27 and the surface of the protective film 26 that occurs due to the thickness of the electrode pattern connected to the opposite ends of the rectangular heating resistors is desirably polished at the same time. In the embodiment 2, the electrode pattern 24 has a thickness of 0.7 μm, and the conductive film 27 has a thickness of 0.8 μm. Thus, if the conductive film 27 is polished to a depth of 0.8 μm or deeper, not only the conductive film directly above the heating resistors is removed, but also the step described above can be removed to provide a smooth seamless surface. Thus, the thickness of the conductive film 27 is preferably equal to that of the electrode pattern 24 or up to 1.2 times greater than the same. If the thickness of the conductive film 27 is smaller than that of the electrode pattern 24, it is difficult to remove the step to provide a seamless surface. On the other hand, if the thickness of the conductive film 27 is more than 1.2 times the thickness of the electrode pattern 24, polishing of the conductive film 27 may take too long, and the efficiency may be decreased.

Figure 10:
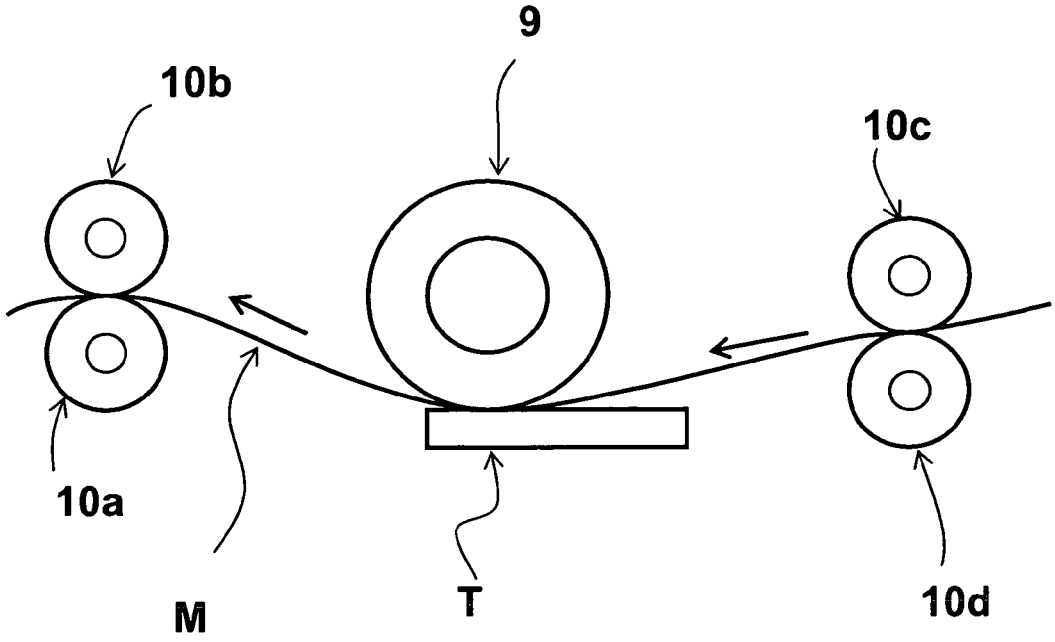
FIG. 10 is a schematic diagram showing a thermal printer incorporating the thermal head shown in FIG. 1.
Figure 11:
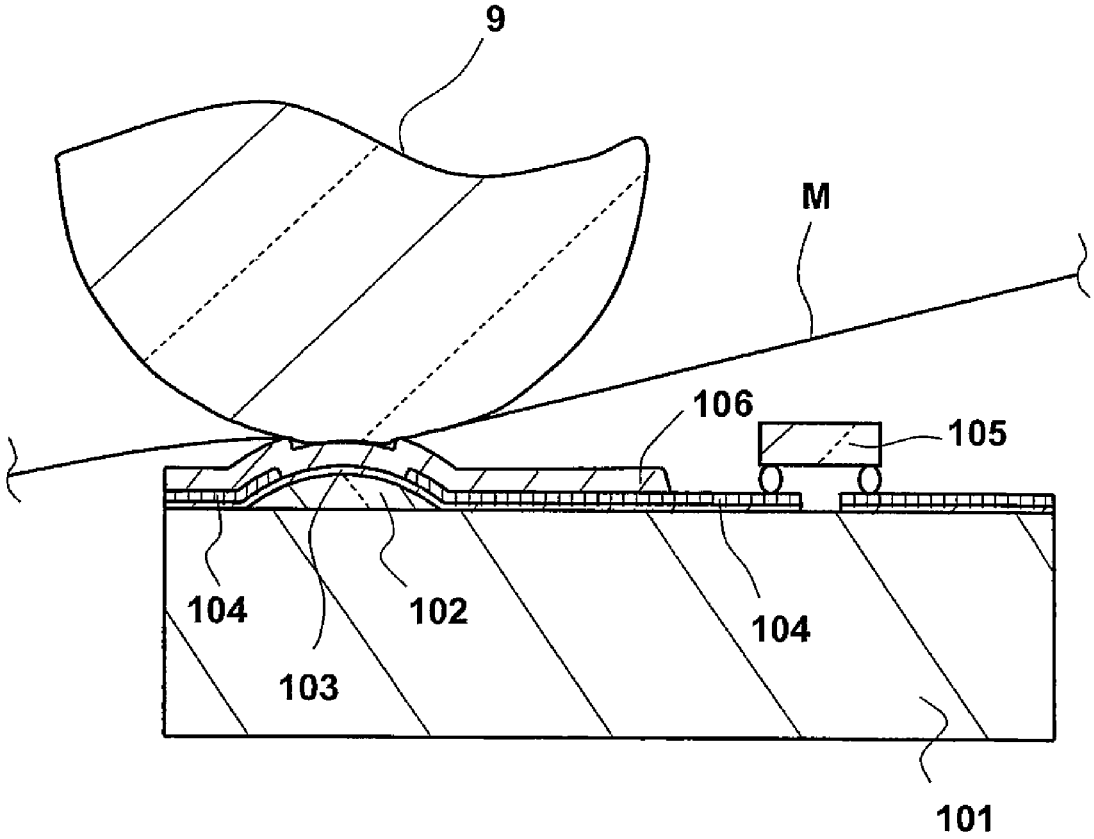
FIG. 11 is a cross-sectional view of a conventional thermal head.

As shown in FIG. 10, a thermal printer incorporating the thermal head described above may include a platen roller 9 and delivery rollers 10*a*, 10*b*, 10*c* and 10*d*.

The platen roller 9 is a cylindrical member comprising a shaft made of a metal, such as SUS, whose periphery is covered with butadiene rubber or the like having a thickness of approximately 3 mm to 15 mm. The platen roller 9 is rotatably supported on the heating resistors 3 of the thermal head T and delivers the recording medium M in the direction indicated by the arrow in this drawing while pressing the recording medium M against the surface of the protective film on the heating resistors 3.

The surface of the platen roller 9 is in contact with the surface of the protective film in the groove 7*a* and the surface of the conductive film in the vicinity of the groove 7*a* with the recording medium interposed therebetween. Thus, during the recording operation, the recording medium is in contact with the surface of the protective film and the surface of the conductive film simultaneously, so that removal of the static electricity on the recording medium and prevention of occurrence of a paper residue of the recording medium can be achieved simultaneously.

The delivery rollers 10*a*, 10*b*, 10*c* and 10*d* have an outer part made of metal, rubber or the like and are disposed on the upstream side (the side of the driver ICs 5) or the downstream side (the side of the heating resistors 3) of the thermal heat T along the delivery direction of the recording medium M. The delivery rollers 10*a*, 10*b*, 10*c* and 10*d* and the platen roller 9 cooperate to support the recording medium M being delivered.

At the same time, the multiple heating resistors 3 are selectively energized via the driver ICs 5 to cause Joule heating therein, and the heat generated is transferred to the recording medium M via the protective film 6 and the conductive film 7, thereby forming a predetermined printed image on the recording medium.

The present invention is not limited to the particular embodiment described above, and various modification and improvements can be made without departing from the spirit of the present invention.

For example, in the embodiment described above, the conductive film 27 is always maintained at the ground potential. Instead, however, the conductive film 27 may be maintained at the ground potential only for a certain period of time.

Furthermore, in the embodiment described above, the conductive film 27 may be made of the same material as the heating resistors 23 and may have a multilayered structure. In the latter case, if the specific resistance of the lowermost layer is equal to or more than $1\times10^7$ Ω.cm, electrical short circuit between the conductive film and the electrode can be extremely highly prevented even if many pinholes or the like are formed in the protective film, which is a base material for the conductive film.

Furthermore, in the embodiment described above, of course, the protective film 26 may have a multilayered structure including two or more layers.

In the case of the thermal head described above, directly above the heating resistors where the pressing force of the platen roller on the thermal head tends to be highest, the recording medium is direct sliding contact with the surface of the protective film having a relatively low surface roughness, so that the frictional force between the recording medium and the thermal head can be effectively reduced. Thus, dielectric breakdown of the protective film can be effectively prevented, so that the protective film can serve adequately for a long time, and a paper residue can be effectively prevented from being produced due to sliding contact between the recording medium and the thermal head, so that the recording medium can be delivered stably.

What is claimed is:

1. A thermal head, comprising:

a substrate;

a plurality of heating resistors aligned on a surface of the substrate;

an electrode pattern connected to the heating resistors;

a protective film that covers said heating resistors and said electrode pattern; and a conductive film that covers an upper surface of said protective film, wherein said conductive film has an opening at least in an area above the arrangement of the heating resistors, the surface of the protective film is exposed through the opening, and an edge of said conductive film adjacent to said opening is inclined outward so that the area of the opening gradually increases as the distance from the exposed surface of the protective film.

2. The thermal head according to claim 1, wherein the surface of the protective film exposed through said opening has a surface roughness equal to or less than 0.06 μm in terms of arithmetic average roughness Ra.

3. The thermal head according to claim 1, wherein said opening has the shape of a groove, and the length of the groove in a sub scanning direction is three to six times greater than the length of the heating resistors in the sub scanning direction.

4. The thermal head according to claim 1, wherein the inner surface of said groove is inclined 60 degrees to 85 degrees from a direction perpendicular to the upper surface of said substrate.

5. A thermal printer comprising: a thermal head according to any of claims 1 to 4; and a platen roller that delivers a recording medium onto the thermal head.

6. The thermal printer according to claim 5, wherein a protective film in a groove and a conductive film in the vicinity of the groove are in contact with the platen roller disposed above a heating resistor via the recording medium.

7. The thermal printer according to claim 5, wherein said conductive film is always or temporarily maintained at a ground potential.

8. The thermal head according to claim 1, further comprising a partial glaze layer provided between the substrate and the heating resistors.

9. A thermal head, comprising:

a substrate;

a plurality of heating resistors aligned on a surface of the substrate;

an electrode pattern connected to the heating resistors;

a protective film that covers said heating resistors and said electrode pattern; and a conductive film that covers an upper surface of said protective film, wherein the surface of said protective film is exposed through said conductive film in a region directly above the heating resistors and downstream of the heating resistors in a direction of delivery of a recording medium, and the surface of an end portion of said conductive film and the surface of the protective film are connected seamlessly to each other.

10. The thermal head according to claim 9, wherein the part of said conductive film located above a gap between adjacent electrode patterns extends longer in the downstream direction of delivery of the recording medium than the part of said conductive film located above said electrode patterns.

11. The thermal head according to claim 10, wherein the part of said conductive film being extended and the part of the protective film directly above the electrode patterns are connected seamlessly.

12. The thermal head according to claim 9, wherein said conductive film has a plurality of first fine recesses extending in the direction of delivery of the recording medium.

13. The thermal head according to claim 12, wherein said conductive film has a second fine recess extending in a direction perpendicular to the direction of said first fine recesses, said first fine recesses being deeper than said second fine recess.

14. The thermal head according to claim 13, wherein the width of said first recesses is greater than the width of said second fine recess.

15. The thermal head according to claim 9, wherein said conductive film has a third fine recess extending in a direction inclined 30 degrees to 60 degrees from the direction of delivery of the recording medium in a plane view.

16. The thermal head according to claim 9, wherein the surface of said protective film is exposed through said conductive film in a region from directly above the heating resistors to the end of the substrate in the downstream direction of delivery of a recording medium.

17. The thermal head according to claim 9, further comprising a partial glaze layer provided between the substrate and the heating resistors.

18. A thermal head comprising:

a substrate;

a plurality of heating resistors aligned on a surface of the substrate;

an electrode pattern connected to the heating resistors;

a protective film that covers said heating resistors and said electrode pattern; and a conductive film that covers an upper surface of said protective film, wherein the surface of said protective film is exposed through said conductive film in a region downstream of the heating resistors in a direction of delivery of a recording medium, the surface of an end portion of said conductive film and the surface of the protective film are connected seamlessly to each other, and said conductive film has a Vickers hardness lower than the Vickers hardness of said protective film.

19. A thermal printer, comprising:

a thermal head according to any of claims 9, 10, 11, 12, 13, 14, 15, and 18; and a platen roller that delivers a recording medium onto the thermal head.

20. The thermal printer according to claim 19, wherein said conductive film is always or temporarily maintained at a ground potential.

21. The thermal head according to claim 18, further comprising a partial glaze layer provided between the substrate and the heating resistors.

22. A thermal head, comprising:

a substrate;

a plurality of heating resistors aligned on a surface of the substrate;

an electrode pattern connected to the heating resistors;

a protective film that covers said heating resistors and said electrode pattern; and a conductive film that covers an upper surface of said protective film wherein the surface of said protective film is exposed through said conductive film in a region downstream of the heating resistors in a direction of delivery of a recording medium, and the thickness of the conductive film extending over the electrode pattern is gradually decrease toward the area above the heating resistors.

23. The thermal head according to claim 22, wherein the area above the heating resistors, there is no conductive film.

24. The thermal head according to claim 22, wherein the end portion of the conductive film close to the area above the heating resistors has a tapered shape so that the width decreases in the downstream direction of the recording medium delivery.

25. A thermal printer, comprising:

a thermal head according to any of claims 22 to 24; and a platen roller that delivers a recording medium onto the thermal head.

26. The thermal printer according to claim 25, wherein said conductive film is always or temporarily maintained at a ground potential.

27. The thermal head according to claim 22, further comprising a partial glaze layer provided between the substrate and the heating resistors.

28. The thermal head according to claim 18, wherein the part of said conductive film located above a gap between adjacent electrode patterns extends longer in the downstream direction of delivery of the recording medium than the part of said conductive film located above said electrode patterns.

29. The thermal head according to claim 18, wherein the part of said conductive film being extended and the part of the protective film directly above the electrode patterns are connected seamlessly.

30. The thermal head according to claim 18, wherein said conductive film has a plurality of first fine recesses extending in the direction of delivery of the recording medium.

31. The thermal head according to claim 18, wherein said conductive film has a second fine recess extending in a direction perpendicular to the direction of said first fine recesses, said first fine recesses being deeper than said second fine recess.

32. The thermal head according to claim 18, wherein the width of said first fine recesses is greater than the width of said second fine recess.

33. The thermal head according to claim 18, wherein said conductive film has a third fine recess extending in a direction inclined 30 degrees to 60 degrees from the direction of delivery of the recording medium in a plane view.

34. A method of manufacturing a thermal head that includes:

a substrate;

a plurality of heating resistors aligned on a surface of the substrate;

an electrode pattern connected to the heating resistors;

a protective film that covers said heating resistors and said electrode pattern; and a conductive film that covers an upper surface of said protective film, the method comprising:

covering the upper surface of said protective film with the conductive film; and removing at least part of said conductive film located above the arrangement of the heating resistors to form an opening that is gradually tapered toward the heating resistors, wherein the surface of the protective film is exposed through the opening.

35. The method of manufacturing a thermal head according to claim 34, wherein said removal of said conductive film is performed by etching or polishing.

36. A method of manufacturing a thermal head that includes:

a substrate;

a plurality of heating resistors aligned on a surface of the substrate;

an electrode pattern connected to the heating resistors;

a protective film that covers said heating resistors and said electrode pattern; and a conductive film that covers an upper surface of said protective film, the method comprising:

covering the upper surface of said protective film with the conductive film; and removing at least part of said conductive film located above the arrangement of the heating resistors to form an opening that is gradually tapered toward the heating resistors, wherein said polishing is performed using a lapping film.

* * * * *